US006508022B2

(12) United States Patent
Huang

(10) Patent No.: US 6,508,022 B2
(45) Date of Patent: Jan. 21, 2003

(54) LIQUID-FILLED ORNAMENT

(75) Inventor: Jing Lin Huang, New Territories (HK)

(73) Assignee: Kiu Hung International Enterprises, Ltd., New Territories (HK)

( * ) Notice: Subject to any disclaimer, the term of this patent is extended or adjusted under 35 U.S.C. 154(b) by 0 days.

(21) Appl. No.: 09/794,394

(22) Filed: Feb. 28, 2001

(65) Prior Publication Data

US 2001/0023547 A1 Sep. 27, 2001

Related U.S. Application Data

(63) Continuation-in-part of application No. 09/285,093, filed on Apr. 2, 1999, now abandoned.

(30) Foreign Application Priority Data

Feb. 11, 1999 (HK) ..... 99100584

(51) Int. Cl.[7] ..... G09F 19/00

(52) U.S. Cl. ..... 40/426; 40/406; 40/409; 40/410

(58) Field of Search ..... 40/406, 409, 410, 40/426, 427, 407

(56) References Cited

U.S. PATENT DOCUMENTS 3,535,805 A * 10/1970 Peiperl ..... 40/406
3,564,740 A 2/1971 Calfee
4,757,986 A 7/1988 Hwang et al.
4,852,283 A 8/1989 Teng
4,961,276 A 10/1990 Lin
5,189,821 A 3/1993 Lee
5,620,353 A 4/1997 Lei
5,743,780 A 4/1998 Liu
6,282,820 B1 * 9/2001 White et al. ..... 40/410

FOREIGN PATENT DOCUMENTS

GB 2268577 1/1994

* cited by examiner

*Primary Examiner*—Lynne H. Browne
*Assistant Examiner*—James M. Hewitt
(74) *Attorney, Agent, or Firm*—Leydig, Voit & Mayer, Ltd.

(57) ABSTRACT

A liquid-filled ornament includes a body having a transparent casing having an opening and filled with liquid, a display object in the liquid, and a sealing wall extending across and sealing the opening. The ornament includes a driving mechanism having rotatable magnets and located on an outer side of the sealing wall, and a driven mechanism having rotatable magnets and located on an inner side of the sealing wall and immersed in the liquid. The magnets of the driven mechanism are rotated by the magnets of the driving mechanism through magnetic interaction. The driven mechanism includes a first stationary disc on which the display object is mounted and a second disc supported on the first disc and rotated by the magnetic interaction. A ball bearing is disposed between the two discs. The second disc includes paddles that stir bits of a solid material, resembling snow, dispersing the bits throughout the liquid.

17 Claims, 4 Drawing Sheets

FIG. 3A
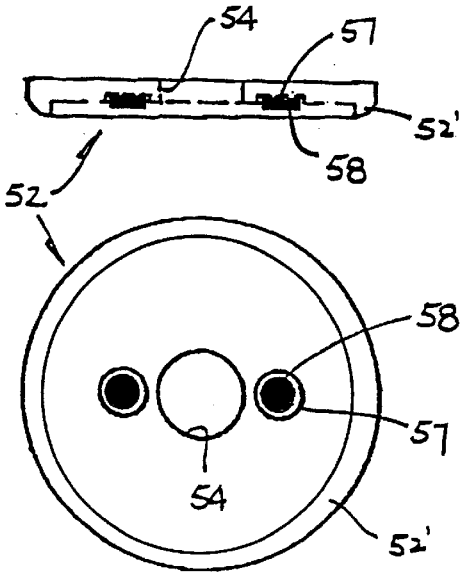
FIG. 4A
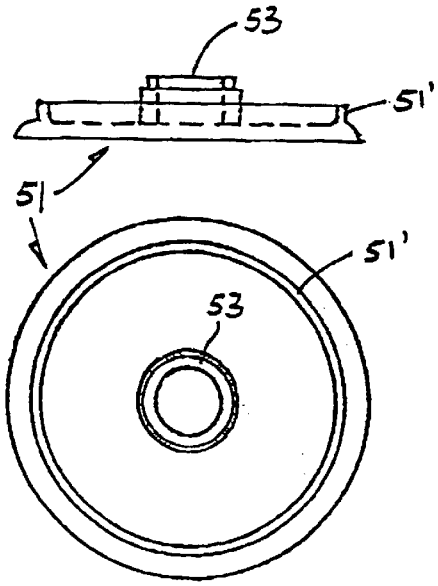
FIG.3B
FIG.4B
FIG. 2A
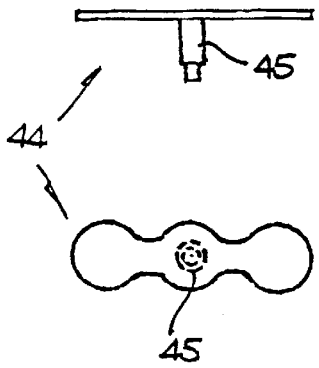
FIG. 5A
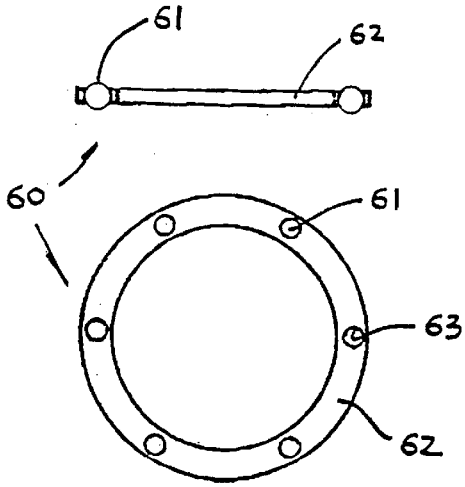
FIG.2B
FIG.5B

LIQUID-FILLED ORNAMENT

This patent application is a continuation-in-part of U.S. patent application Ser. No. 09/285,093 filed Apr. 2, 1999, now abandoned.

present invention relates to a liquid-filled ornament.

BACKGROUND OF THE INVENTION

Water-filled ornaments are known, such as a display device as disclosed in U.S. Pat. No. 4,852,283, which contain a creature immersed in water and that is movable through interaction between a driving magnet and a driven magnet.

The present invention introduces an improved liquid-filled ornament.

SUMMARY OF THE INVENTION

According to the invention, there is provided a liquid-filled ornament comprising a base; a transparent casing having an opening, filled with a liquid, and mounted on the base; a sealing wall extending across and sealing the opening against loss of the liquid from the casing; a driving mechanism located within the base and including a motor having a motor shaft, a bar, a gearing arrangement coupling the bar to the motor shaft so that the bar is rotated by operation of the motor, and a pair of magnets mounted on opposite ends of the bar that are separated from the motor shaft; a driven mechanism located in the casing and including a stationary first member, a rotatable second member rotatably supported on the first member and including a plurality of outwardly extending paddles for stirring the liquid upon rotation of the second member; a pair of magnets positioned on the second member, alignable with the pair of magnets mounted on the bar, for magnetic interaction with the pair of magnets mounted on the bar, so that the second member is rotated by rotation of the bar, and a ball bearing interposed between the first member and the second member; a display object mounted on the first member and visible in the liquid; and bits of a solid material disposed in the liquid and dispersed through the liquid by the paddles upon rotation of the second member.

Preferably, the first and second members of the driven mechanism are respective discs.

More preferably, one of the first and second discs has a peripheral flange for positioning the ball bearing.

It is preferred that the first disc have a shaft and the second disc have a hole, through which the shaft extends, for connecting the two discs together.

In a preferred construction, the ball bearing includes roller balls and a ring with respective holes holding the roller balls.

In a first preferred embodiment, the display object is mounted on and turns with the second member of the driven mechanism.

In a second preferred embodiment, the display object is free to move in the liquid, and the second member of the driven mechanism includes a paddle for swirling the liquid, which will, in turn, carry with it and turn the display object.

More preferably, the second member of the driven mechanism includes paddles arranged equi-angularly.

It is preferred that the driving mechanism incorporate a spring motor.

Preferably, the sealing wall forms part of a cap-like stopper fitted within the opening of the casing.

In a preferred construction, the casing is substantially spherical, and the body includes a base supporting the casing and containing the driving mechanism.

BRIEF DESCRIPTION OF DRAWINGS

The invention will now be more particularly described, by way of example only, with reference to the accompanying drawings, in which:

FIGS. 2A and 2B, 3A and 3B, 4A and 4B, 5A and 5B are, respectively, side and top/bottom views of certain parts of the ornament of FIG. 1;

DETAILED DESCRIPTION OF PREFERRED EMBODIMENTS

Figure 1:
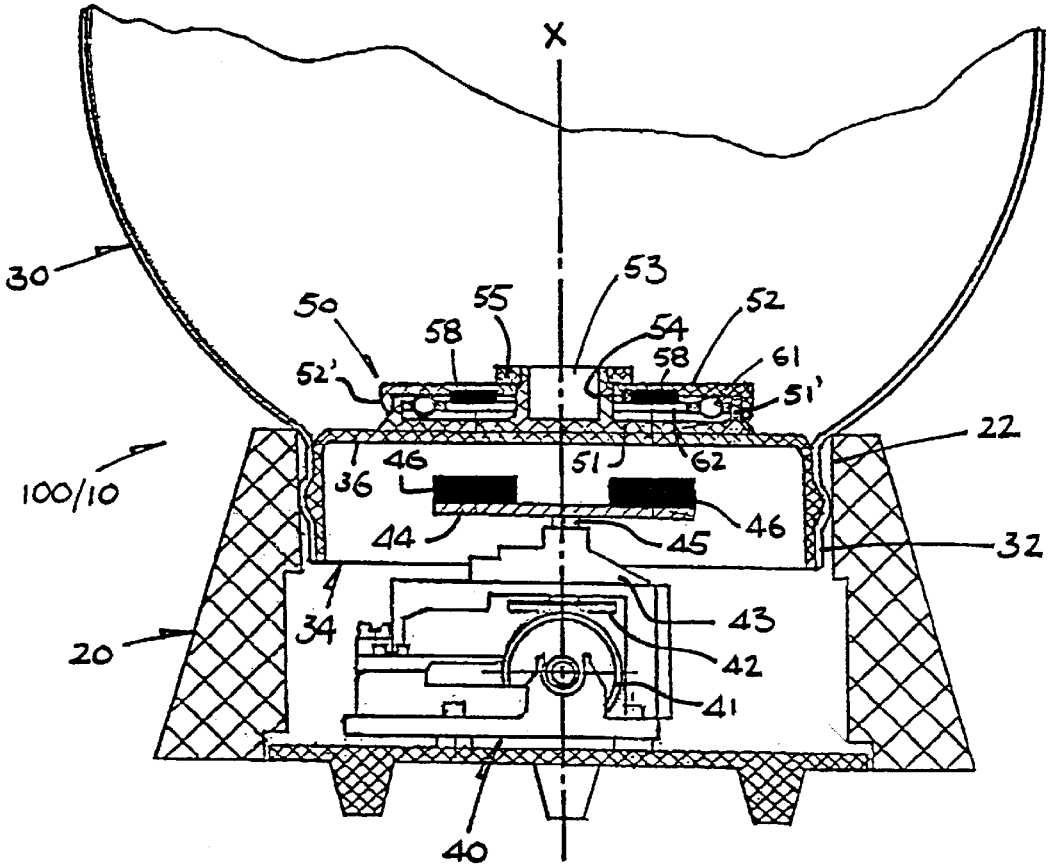
FIG. 1 is a cross-sectional side view of a first embodiment of a liquid-filled ornament in accordance with the invention.

Referring initially to FIGS. 1 through 5B of the drawings, there is shown a first liquid-filled ornament 100 embodying the invention, which ornament 100 has a body 10 having a vertical central axis X and including a round hollow base 20 and a spherical transparent glass casing 30 supported on the base 20, like a crystal ball, the casing 30 having a central bottom opening 32. The base 20 has a circular central top opening 22 receiving the bottom neck of the casing 30 in a press fit. The casing 30 is filled with water and sealed by a cap-like rubber stopper 34 tight fitted within the bottom opening 32, the stopper 34 having a horizontal circular sealing wall 36 extending across the bottom opening 32.

The ornament 100 includes a driving mechanism 40 located on the outer side of the sealing wall 36 within the base 20 and a driven mechanism 50 provided on the inner side of the stopper wall 36 and immersed in water filling the casing.

The driving mechanism 40 incorporates a spring motor having a driving gearwheel 41 and a driven gearwheel 42 rotated by the driving gearwheel 41 about the axis X. The mechanism 40 includes a pair of magnets 46 rotatable by the driven gearwheel 42. The magnets are glued to the opposite ends of a horizontal iron bar 44. The bar 44, shown in FIGS. 2A and 2B, has a vertical central shaft 45 which is coupled to the driven gearwheel 42, for drive transmission, by means of a coupler 43. This gearing arrangement of the gearwheels 41 and 42, and of the coupler 43 and central shaft 45, permits adjustment of the speed of the paddles or display object so that a small inexpensive spring driven or electrical motor can be used in the drive mechanism 40. If the motor has a high speed, it can be reduced by the gearing arrangement. The magnets 46 are positioned within the stopper 34 at a position immediately below the sealing wall 36.

The driven mechanism 50 includes, as a stationary first member, a fixed base disc 51, i.e., a first disc, mounted on the sealing wall 36, an upper, second disc 52, shown in FIGS. 3A and 3B, supported co-axially on the base disc 51 for free rotation about the axis X, and an annular ball bearing 60, shown in FIGS. 5A and 5B, located between the two discs 51 and 52 for facilitating rotation of the upper disc 52, a rotatable second member. The base disc 51 has a short central tubular shaft 53 which extends upwards through a central hole 54 of the upper disc 52 for positioning the upper disc 52 and is fitted with an end ring 55 for retaining the upper disc 52. The upper disc 52 has an underside including a pair of diametrically opposite recesses 57 in which a pair of magnets 58 are held by glue. A display object, such as a dancer, is mounted on the upper disc 52.

The ball bearing 60 includes six balls 61 and a flat ring 62 with respective holes 63 holding the balls 61. The base and upper discs 51 and 52 include respective upstanding and depending peripheral flanges 51', and 52', with the upstanding flange 51' positioning the ball bearing 60 and surrounded by the depending flange 52', both in a loose fit. The magnets 58 are within the ring 62 when viewed from above or below and positioned as close as possible to the magnets 46 below. The centers of the magnets 58 are spaced apart by the same distance as the magnets 46.

In operation, the spring driving mechanism 40 is wound to turn the magnets 46. By reason of magnetic attraction, the magnets 58 of the driven mechanism 50 will be turned in the same directions as magnets 46 resulting in turning of the upper disc 52 and hence a display object mounted on disc 52. The use of the ball bearing 60 considerably reduces the friction associated with the driven mechanism 50.

Figure 7A:
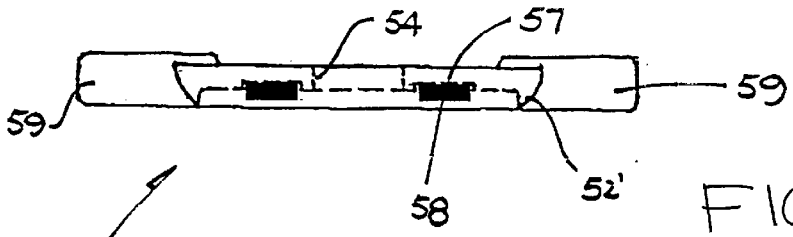
FIGS. 7A and 7B are side and bottom plan views of a part of the ornament of FIG. 6.
Figure 7B:
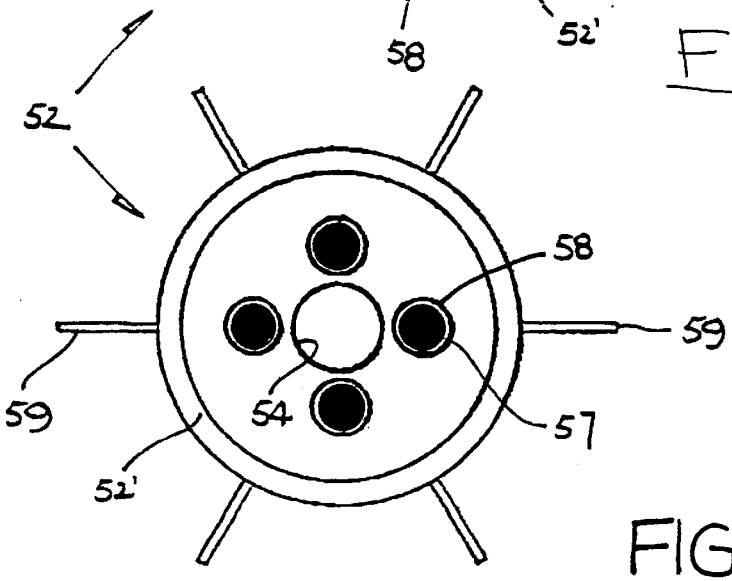
Figure 6:
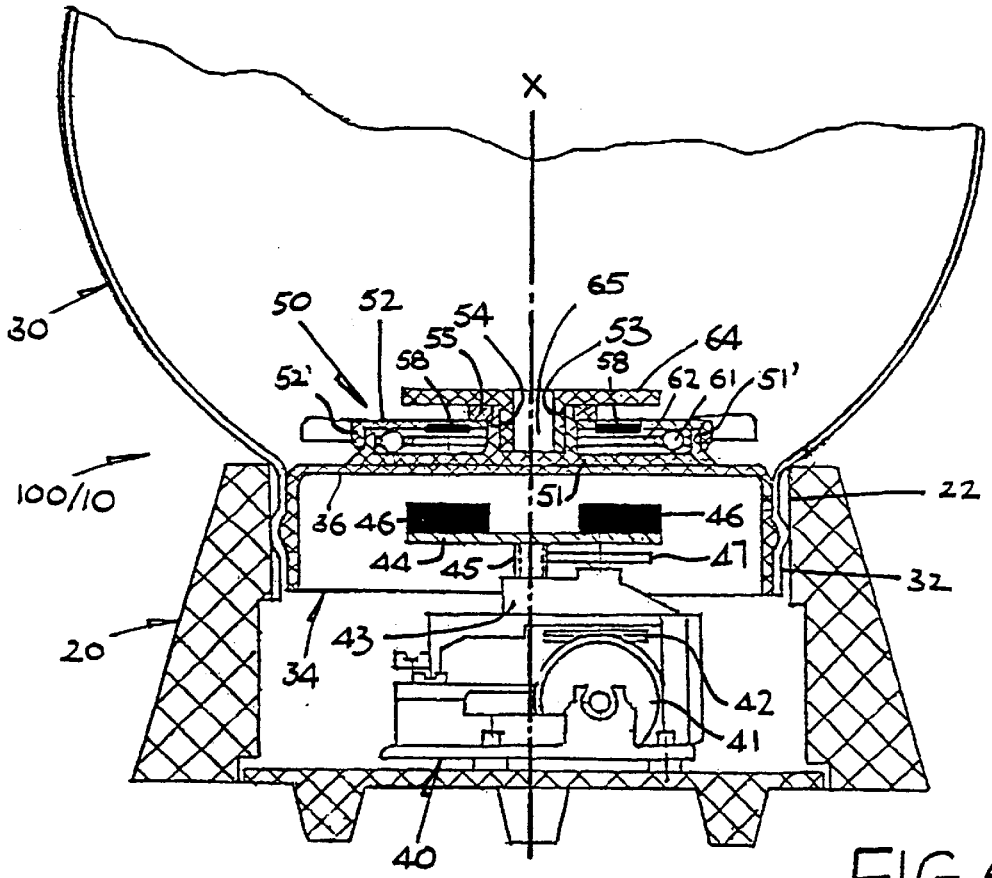
FIG. 6 is a cross-sectional side view of a second embodiment of a liquid-filled ornament in accordance with the invention.

Referring now to FIGS. 6A, 7A, and 7B of the drawings, there is shown a second liquid-filled ornament 200 embodying the invention, which has a construction similar to that of the first ornament 100, except as described below, with equivalent parts designated by the same reference numerals. In the driving mechanism 40, the shaft 45 of the bar 44 has external teeth like a pinion, and is rotatably supported on one side of the coupler 43. The coupler 43 also supports an additional gearwheel 47 for rotation with the driven gearwheel 42, the gearwheel 47 being engaged with the toothed shaft 45 for drive transmission at a reduced speed such that the bar 44 is arranged to rotate at a lower speed than that of the first ornament 100.

In the driven mechanism 50, the upper disc 52 is provided with four equi-angularly spaced magnets 58 positioned by respective recesses 57, and includes six equi-angularly spaced and radially extending paddles 59. The mechanism 50 includes an additional top disc 64 which has a central bottom boss 65 and is located above the upper disc 52 with its boss 65 press-fitted coaxially into the tubular shaft 53 of the base disc 51. The top disc 64 is stationary, and the display object may be fixed on the top disc 64 or merely loosely placed there.

Figure 8:
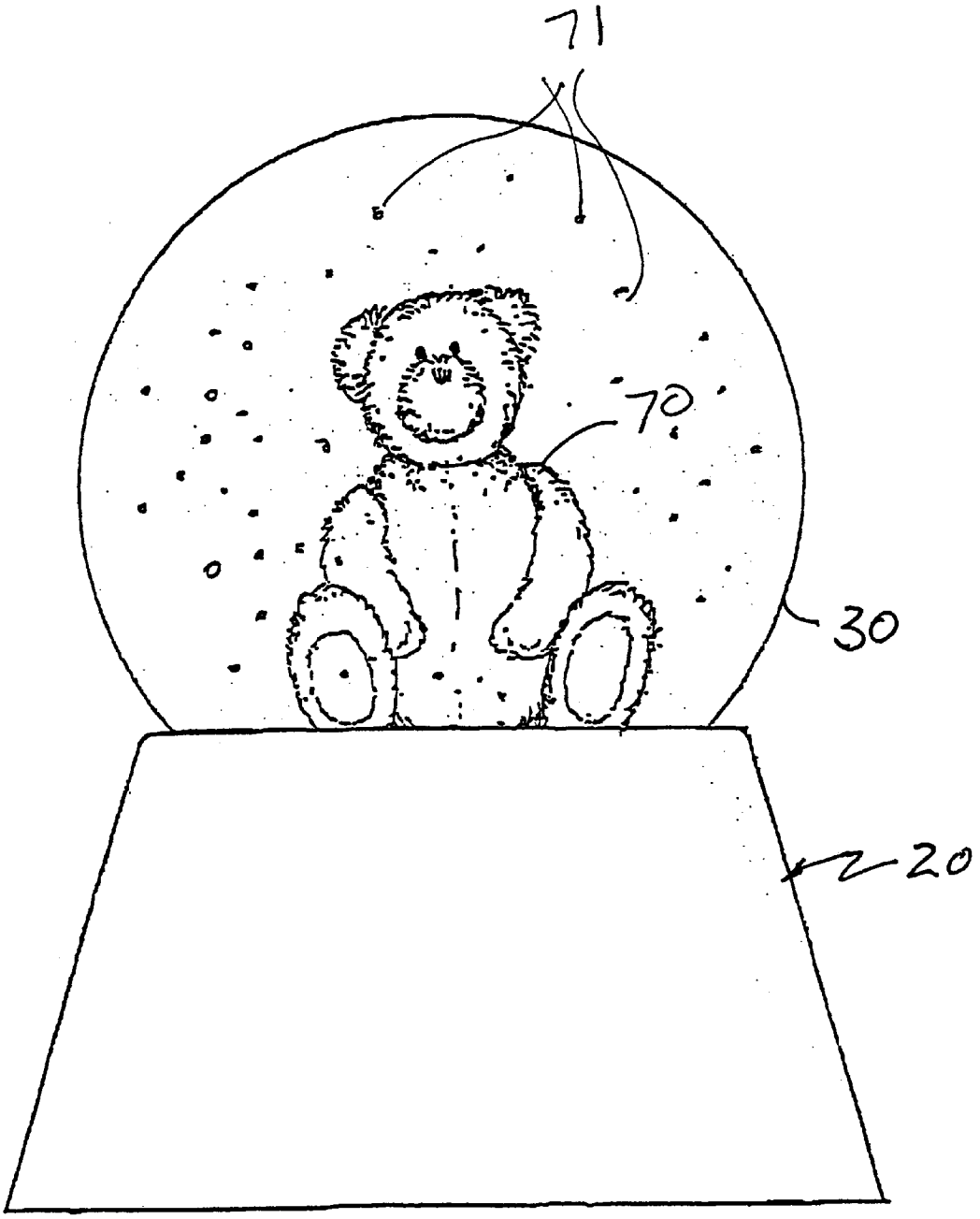
FIG. 8 is a front view of a liquid-filled ornament according to an embodiment of the invention.

Another liquid-filled ornament according to the invention is shown in a front view in FIG. 8. In that embodiment and in the embodiment depicted in FIGS. 6, 7A, and 7B, the spherical casing 30 contains a display object 70, such as the illustrated teddy bear. Further, small display pieces, such as white plastic bits 71, shown in FIG. 8, are disposed in and freely move in the water. When the water is swirled by the moving of the paddles 59, the white bits 71 simulate snow falling around the display object. The display object 70 may be mounted on the top disc 64 or be free to move in the water.

The operation of the second ornament 200 is similar to that of the first ornament 100, in which the upper disc 52 will be turned through magnetic interaction between the lower driving magnets 46 and the upper driven magnets 58. Upon turning, the paddles 59 will swirl the water, which will in turn carry with it and churn the white bits to simulate a snowfall scene around the display object inside the casing.

The invention has been described by way of example only, and various other modifications of and/or alterations to the described embodiments may be made by persons skilled in the art without departing from the scope of the invention as specified in the appended claims.

What is claimed is:

1. A liquid-filled ornament comprising:

a base;

a transparent casing having an opening, filled with a liquid, and mounted on the base;

a sealing wall free of holes, extending across, and sealing the opening against loss of the liquid from the casing;

a driving mechanism located within the base and including:

a motor having a motor shaft;

a bar;

a gearing arrangement coupling the bar to the motor shaft so that the bar is rotated by operation of the motor; and a pair of magnets mounted on opposite ends of the bar that are separated from the motor shaft;

a driven mechanism located entirely within the casing and including:

a stationary first member;

a rotatable second member rotatably supported on the first member and including a plurality of outwardly extending paddles for stirring the liquid upon rotation of the second member;

a pair of magnets positioned on the second member, alignable with the pair of magnets on the bar, for magnetic interaction with the pair of magnets mounted on the bar, so that the second member is rotated by rotation of the bar, and a ball bearing interposed between the first member and the second member;

a display object mounted on the first member and visible in the liquid; and bits of a solid material disposed in the liquid and disposed through the liquid by the paddles upon rotation of the second member.

2. The liquid-filled ornament as claimed in claim 1, wherein the first and second members of the driven mechanism are first and second discs.

3. The liquid-filled ornament as claimed in claim 2, wherein one of the first and second discs has a peripheral flange for positioning the ball bearing.

4. The liquid-filled ornament as claimed in claim 2, wherein the first disc includes a shaft and the second disc includes a hole, through which the shaft extends, connecting the two discs together.

5. The liquid-filled ornament as claimed in claim 1, wherein the ball bearing includes a plurality of roller balls and a ring having respective holes holding the balls.

6. The liquid-filled ornament as claimed in claim 1, wherein the paddles are arranged at a uniform pitch.

7. The liquid-filled ornament as claimed in claim 1, wherein the driving mechanism includes a spring motor.

8. The liquid-filled ornament as claimed in claim 1, wherein the sealing wall is part of a cap-like stopper fitted within the opening of the casing.

9. The liquid-filled ornament as claimed in claim 1, wherein the casing is substantially spherical.

10. The liquid-filled ornament as claimed in claim 1, wherein the stationary first member includes a platform on which the display object is mounted and a tubular portion extending transverse to the platform, and the rotatable second member is annular and includes a central hole, the tubular portion of the first member being disposed within the central hole.

11. The liquid-filled ornament as claimed in claim 10, wherein the driven mechanism includes a base disposed on the sealing wall and a tubular portion receiving the tubular portion of the first member and disposed within the central opening of the second member.

12. The liquid-filled ornament as claimed in claim 11, wherein the base has a peripheral flange for positioning the ball bearing.

13. The liquid-filled ornament as claimed in claim 11, wherein the ball bearing includes a plurality of roller balls and a ring having respective holes holding the balls.

14. The liquid-filled ornament as claimed in claim 10, wherein the paddles are arranged at a uniform pitch.

15. The liquid-filled ornament as claimed in claim 10, wherein the driving mechanism includes a spring motor.

16. The liquid-filled ornament as claimed in claim 10, wherein the sealing wall is part of a cap-like stopper fitted within the opening of the casing.

17. The liquid-filled ornament as claimed in claim 10, wherein the casing is substantially spherical.

* * * * *